US006761208B2

(12) United States Patent
Whealy et al.

(10) Patent No.: US 6,761,208 B2
(45) Date of Patent: Jul. 13, 2004

(54) METHOD AND APPARATUS FOR DIE-CASTING A V-BLOCK FOR AN INTERNAL COMBUSTION ENGINE

(75) Inventors: Gregg Edward Whealy, Losantville, IN (US); Ryan Andrew Haas, Yorktown, IN (US)

(73) Assignee: Delaware Machinery & Tool Co., Muncie, IN (US)

( * ) Notice: Subject to any disclaimer, the term of this patent is extended or adjusted under 35 U.S.C. 154(b) by 0 days.

(21) Appl. No.: 10/264,151

(22) Filed: Oct. 3, 2002

(65) Prior Publication Data

US 2004/0065430 A1 Apr. 8, 2004

(51) Int. Cl.[7] ..... B22D 17/26
(52) U.S. Cl. ..... 164/340; 164/341
(58) Field of Search ..... 164/339–343, 164/137, 347

(56) References Cited

U.S. PATENT DOCUMENTS

| | | | | |
|---|---|---|---|---|
| 3,165,796 A | | 1/1965 | McDonald | 22/93 |
| 3,433,292 A | | 3/1969 | McDonald | 164/343 |
| 3,596,708 A | | 8/1971 | Lapin | 164/343 |
| 4,206,799 A | | 6/1980 | McDonald | 164/341 |
| 4,981,168 A | * | 1/1991 | Koch et al. | 164/137 |
| 5,204,127 A | | 4/1993 | Prusha | 425/544 |
| 5,338,171 A | | 8/1994 | Hayakawa et al. | 425/138 |
| 5,429,175 A | | 7/1995 | Thieman et al. | 164/312 |
| 5,551,864 A | | 9/1996 | Boskovic | 425/556 |
| 5,865,241 A | | 2/1999 | Bishenden et al. | 164/137 |

* cited by examiner

*Primary Examiner*—Kiley Stoner
*Assistant Examiner*—Len Tran
(74) *Attorney, Agent, or Firm*—Brinks Hofer Gilson & Lione

(57) ABSTRACT

A die for die-casting a V-block for an internal combustion engine may be operated by a wide range of die-casting machines, including those with inadequate capacity to operate the normally heavy dies for large cast parts. Such a die includes, in addition to a stationary die element for the stationary platen of a die-casting machine, only a single movable die element carried by the tie bars and slides of a die-casting machine and carrying the cylinder-forming die core pieces, means for locking the die core pieces in their extended cylinder-forming positions, and the plurality of cavity-forming slides.

16 Claims, 9 Drawing Sheets

METHOD AND APPARATUS FOR DIE-CASTING A V-BLOCK FOR AN INTERNAL COMBUSTION ENGINE

TECHNICAL FIELD

This invention relates to die-casting methods and apparatus, and more particularly, to methods and apparatus for die-casting V-blocks for internal combustion engines.

BACKGROUND OF THE INVENTION

Die-casting is being used for the manufacture of larger and larger articles. Such large automotive parts as internal combustion engine blocks and the housings for automatic transmissions are now commonly manufactured with die-casting as the first step in formation of the part. Such parts have extensive and complex surfaces with close tolerances; and die-casting permits their formation in high production, eliminating costly machining operations and saving metal. Die-casting requires extreme pressures exerted on the liquid metal and large amounts of heat are released from the molten metals as they change state. Massive dies are required to maintain dimensional tolerances within the limits making such operations economically attractive and to provide the strength to withstand the stresses resulting from high pressures and forces. The die-casting molds for such large automotive parts as automatic transmission housings are, for example, frequently seven to eight feet (2.1–2.5 meters) tall, seven to eight fee (2.1–2.5 meters) wide, and six to seven feet (1.8–2.1 meters) thick when closed, and must be manufactured from high-grade, high-tensile strength steel. (The words "mold" and "die" are used interchangeably herein.)

Such molds frequently include one stationary element, one movable element operated by the die-casting machine to close the mold, and several slidable elements referred as "slides" that move transversely of the direction of movement of the die-casting machine to provide a mold cavity with intricate and re-entrant surface configurations. The mold slides, which slide transversely of the direction of movement of the die-casting machine, are generally moved by hydraulic cylinders to their proper positions.

Die-casting has become desirable as a manufacturing method for parts such as automobile engine blocks and transmission housings because it can produce intricately shaped parts to close tolerances. Die-casting can provide such parts with strength and intricately shaped surfaces without extensive and expensive machining operations. Such parts have wall thicknesses designed to take advantage of the economy of die-casting operations. Misalignment of the mold parts due, for example, to warping of the mold, misalignment of the mold on the molding machine, or non-parallelism in the molding machine platen surfaces or their direction of the movement, can vary wall thicknesses and distort part surface dimensions to unacceptable limits and result in a substantial waste of die-cast parts.

The die-casting of V-blocks for internal combustion engines poses a difficult problem because the formation of the cylinders of a V-block requires a plurality of cylinder-forming die core elements that must be moved in the die at the acute angle on which the internal combustion engine's pistons will operate, and because the V-blocks are large and heavy and are subject to close tolerances in their dimensions.

In the die-casting of such engine blocks, a plurality of movable die parts are registered in a die-closed position to form a die cavity, and are subsequently retracted to permit removal of the cast part from the die. These die parts must be held in place in the closed position against extremely high molten metal injection forces, sometimes up to 500,000 to 1,000,000 pounds. The die parts, which are movable in a direction coinciding with the principal or longitudinal direction of movement of the die-casting machine, are locked in place by the closing mechanism of the die-casting machine itself. The die parts, or slides, which move in a direction parallel to the parting plane, which is perpendicular to the axis of movement of the die-casting machine, are locked in place when the die is closed by interacting surfaces on the slides and the die cover and the closing mechanism of the die-casting machine. Even though substantial force builds up during the metal injection step in die-casting, movable die members can be satisfactorily locked in a die-closed position by the forces imposed thereon by the closing mechanism of the die-casting machine when they move only in these two directions. However, the locking of die core elements which are movable at an acute angle with respect to the longitudinal axis of the die-casting machine has presented a different and difficult problem.

Wherever the descriptions herein refer to die core pieces or die core elements, or cylinder-forming die core pieces, the references refer to those die elements that move on an acute angle with respect to the direction of movement of the die-casting machine and can carry and position cylinder-forming sleeves in the V-block casting or can otherwise form the cylinders of the V-block casting.

U.S. Pat. No. 3,433,292 discloses a die in which the die core elements have been locked in die-closed positions by engagement of a back-up plate with the piston rods of the separate hydraulic cylinder means used for moving the die core elements. This locking mechanism has not been satisfactory because the large angular forces imposed on the piston rods by the injection pressure of the molten metal adversely affect the packings of the hydraulic cylinders, and cause rapid wear in the area of contact between the piston ends and the back-up plate because of sliding action and relatively small contact areas.

U.S. Pat. No. 4,206,799 discloses a further development in the die-casting of V-blocks by providing in a die an ejector die assembly comprising, in addition to a plurality of slides, a plurality of die members including die core elements movable relative to the die assembly in a direction at an acute angle to the longitudinal axis of movement of the die-casting machine, and a separate back-up plate means connected with the die-casting machine and attached to the back side of the ejector die assembly by a lost motion connection. In this die assembly, when the machine is in the closed position, the die members of the ejector die assembly, including the angularly movable die core elements, register in the die-closed position to define a cavity therebetween, and in this position, the back-up plate means is held against the rear side of the ejector die assembly and against the rear sides of the angularly movable die core elements by the closing mechanism of the die-casting machine. The integrity of the cavity in the die-closed position is thus maintained. As the die is opened by the die-casting machine, the back-up plate means is withdrawn from the ejector die assembly to the limit of the lost motion connection, and the movable die core elements are retracted. Further withdrawal of the back-up plate means by the die-casting machine moves the ejector die assembly to the full die-open position.

U.S. Pat. No. 5,868,241 discloses an alleged improvement on the V-block die of U.S. Pat. No. 4,206,799 to provide cast V-blocks with closer tolerances. The die disclosed in U.S. Pat. No. 5,865,241 differs from the die disclosed in U.S. Pat. No. 4,206,799 by the addition of complementary male and female surface on the back-up plate (referred to as "the ejection box") and the ejector die assembly (referred to as "the ejector holder block") to more precisely locate the ejector die assembly (the ejector holder block) with respect to the back-up plate (ejection box) when the two parts are moved into abutment by the die-casting machine, and by the addition of an actuator, in addition to die-casting machine actuator, for moving the back-up plate (ejection box) and the ejector die assembly (the ejector holder block) into abutment.

Thus, recent developments of dies for die-casting V-blocks for internal combustion engines have included a first movable die element (referred to above as an "ejector die assembly" and an "ejector holder block"), which is carried by the slides and tie bars of the die-casting machine, and which carries the cylinder-forming die core elements reciprocatably, between their extended cavity-forming positions and their retracted part-ejection positions, along axes lying at acute angles with respect to the direction of the die closing and opening movement of the die-casting machine, and a plurality of cavity-forming slides and their hydraulic cylinder actuators. Such recent dies have also included a second movable part connected to the movable platen of the die-casting machine (referred to above as a back-up plate and an ejection block), which is also carried by the slides and tie bars of the die-casting machine separately from the first movable die element to provide a gap between it and the first movable die element for access to the cylinder-forming die core pieces and to provide forward surfaces to abut the cylinder-forming die core pieces in their extended cavity-forming positions to hold, with the closing mechanism of the die-casting machine, the cylinder-forming die core pieces in their extended cylinder-forming positions against the high pressures that are imposed by the injection pressure of the molten metal. Such dies include not only the movable die elements described above, but also a stationary die element (frequently referred to as the "die cover"). Such dies are expensive and frequently too massive and heavy for use with many smaller capacity die-casting machines.

Accordingly, a less expensive and less massive die for die-casting V-blocks for internal combustion engines is needed and will be advantageous.

BRIEF SUMMARY OF THE INVENTION

The invention provides an inexpensive die for die-casting a V-block for an internal combustion engine, which may be operated by a wide range of die-casting machines, including those with inadequate capacity to operate heavy dies for large cast parts. Dies of the invention include, in addition to a stationary die element for the stationary platen of a die-casting machine, only a single movable die element carried by the tie bars and slides of a die-casting machine, carrying the cylinder-forming die core pieces, means for locking the die core pieces in their extended cylinder-forming positions, and the plurality of cavity-forming slides.

The invention provides a die for forming a die cavity for casting a V-block for an internal combustion engine, comprising, in addition to a stationary die element for mounting on the stationary platen of a die-casting machine, a movable die element for mounting on the movable platen of a die-casting machine for movement into cavity-forming engagement with the stationary die element, said movable die element including a cavity-forming surface portion, and carrying a plurality of slides including cavity-forming surfaces for movement transversely with respect to the movement of the movable platen, a plurality of cylinder-forming die core pieces reciprocatable at acute angles in said movable die element between extended positions in the die cavity and retracted positions substantially within said movable die element, and die core locking means, carried by the movable die element, between a first position engaging and locking the die core pieces in their extended cavity-forming positions and a second position free of contact with the die core pieces. The die core locking means preferably comprises a die core locking member having forward die core engaging portions and reciprocatable within the movable die element between a first forward position where its forward die core engaging portions engage rear portions of the die core pieces in their extended positions and a second rearward position out of contact with the die core pieces, and a pair of locks carried by the movable die element for movement transversely of the movement of the die core locking member between first positions between the die core locking member and an internal surface of the movable die element, thereby locking the die core pieces in their extended positions and second positions free of engagement with the die core locking member.

Other features and advantages of the invention will be apparent to those skilled in the art from the drawings and the more detailed description that follows.

DESCRIPTION OF THE BEST MODE OF THE INVENTION

FIGS. 1–8 diagrammatically illustrate from above a die 20 of the invention mounted on the stationary platen 11 and movable platens 12 of a die-casting machine.

Figure 1:
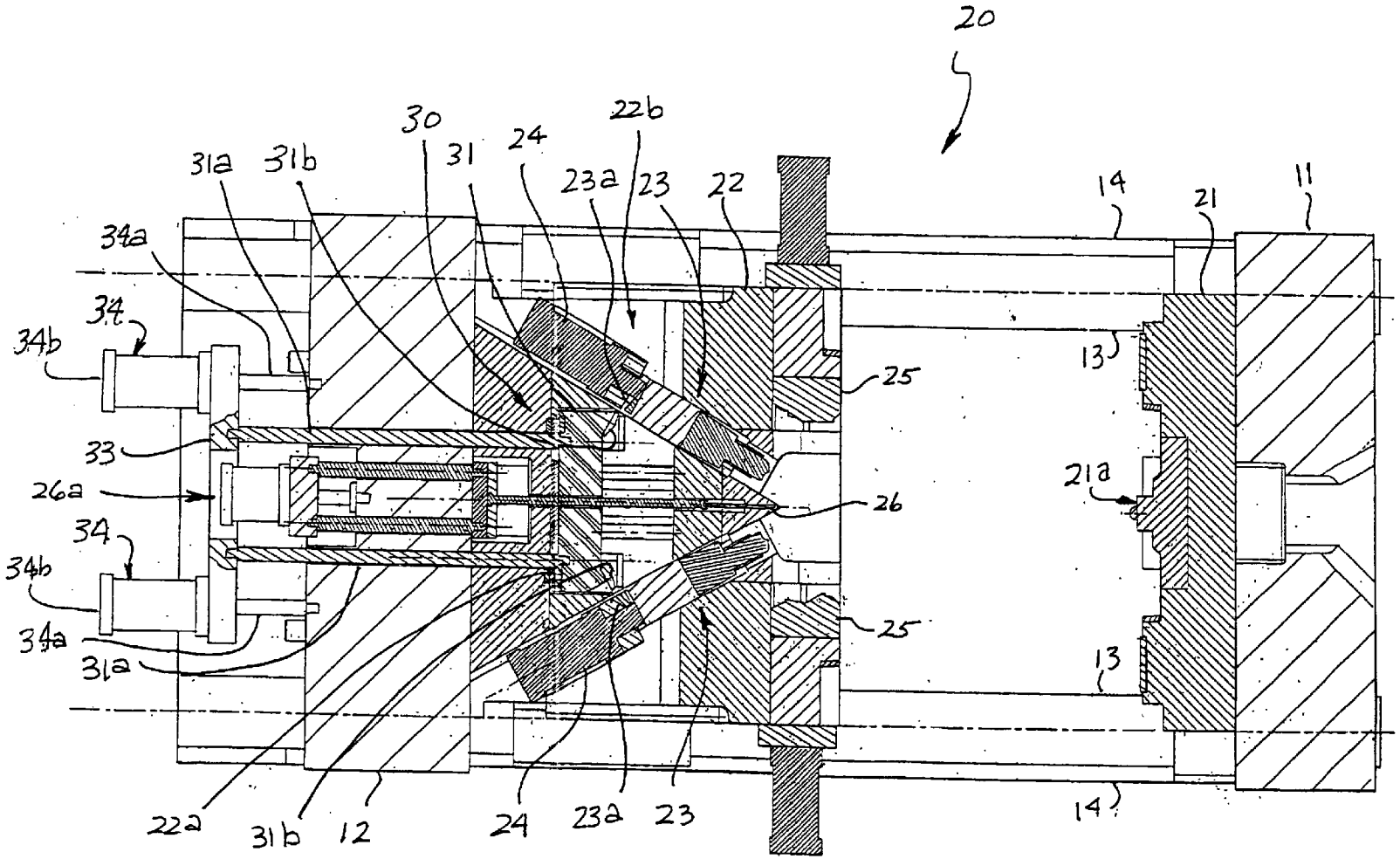
FIG. 1 is an illustration, from above, of a cross-section of a die of the invention mounted on the stationary and movable platens of a die-casting machine in the die open position, said cross-section being taken on a horizontal plane through the cylinder-forming die core pieces.

Referring now to FIG. 1, the die 20 of the invention includes a stationary die element 21 mounted on the stationary platen 11 and a movable die element 22 mounted on the movable platen 12 of the die-casting machine for movement toward and away from the stationary die element 21. A pair of cylinder forming die core pieces 23 are reciprocatably carried in the movable die element 22 at acute angles to the direction of movement of the movable die element 22 toward and away from the stationary die element 21. A pair of hydraulic cylinders 24 drive the die core pieces 23 outwardly and inwardly of the movable die element 22 and, respectively, toward and away from the stationary die element 21 (Compare FIGS. 1 and 2). As illustrated, the die core pieces 23, and their actuating hydraulic cylinders 24, are enclosed within the movable die element 22. The movable die element 22, and the plurality of die core pieces 23 within it, are carried by the movable platen 12 on the tie bars 13 and side rails 14 of the die-casting machine.

Figure 2:
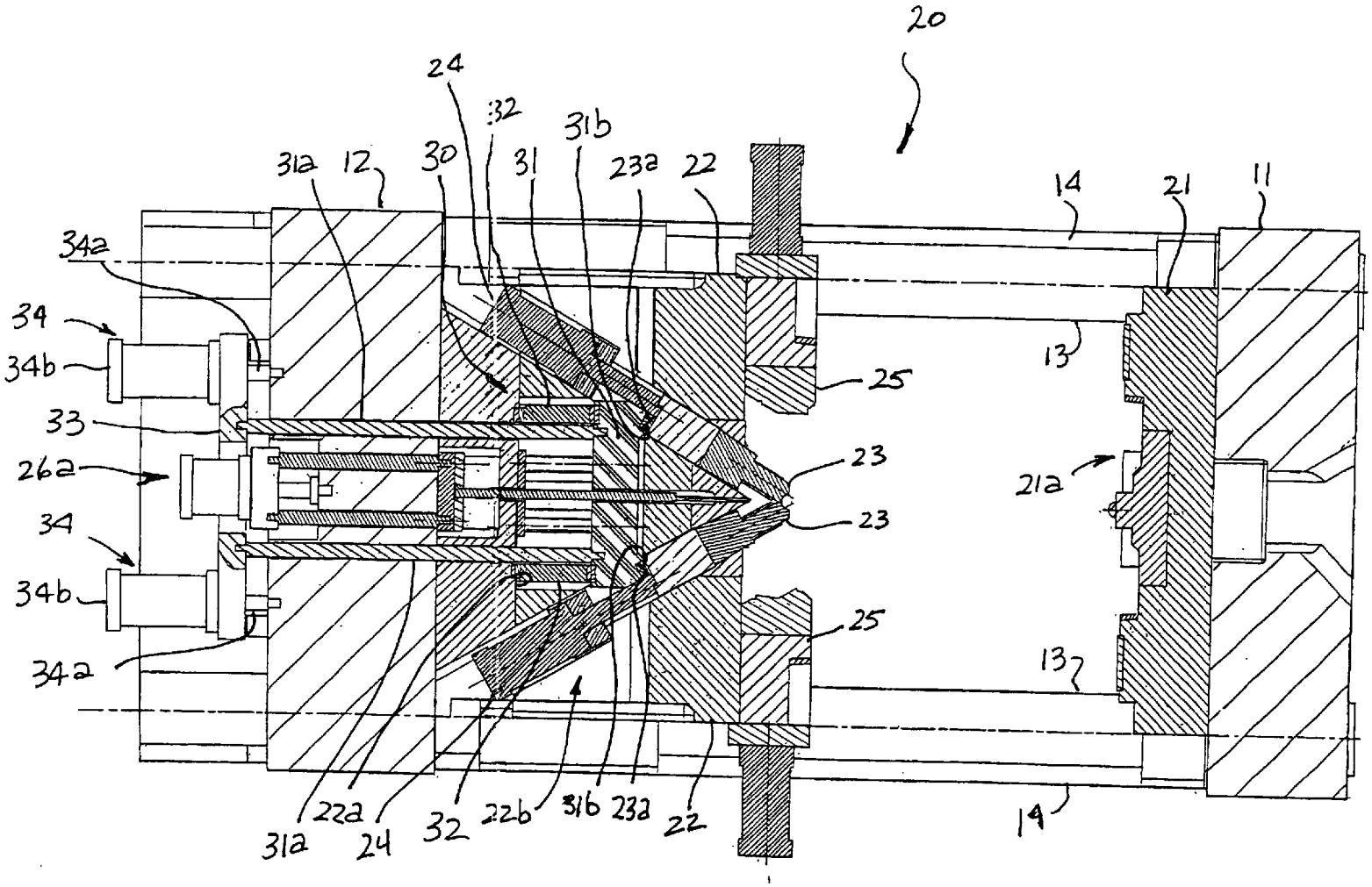
FIG. 2 is an illustration, corresponding to FIG. 1, of the die of FIG. 1 with its cylinder-forming die core pieces extended in their cylinder-forming positions.
Figure 3:
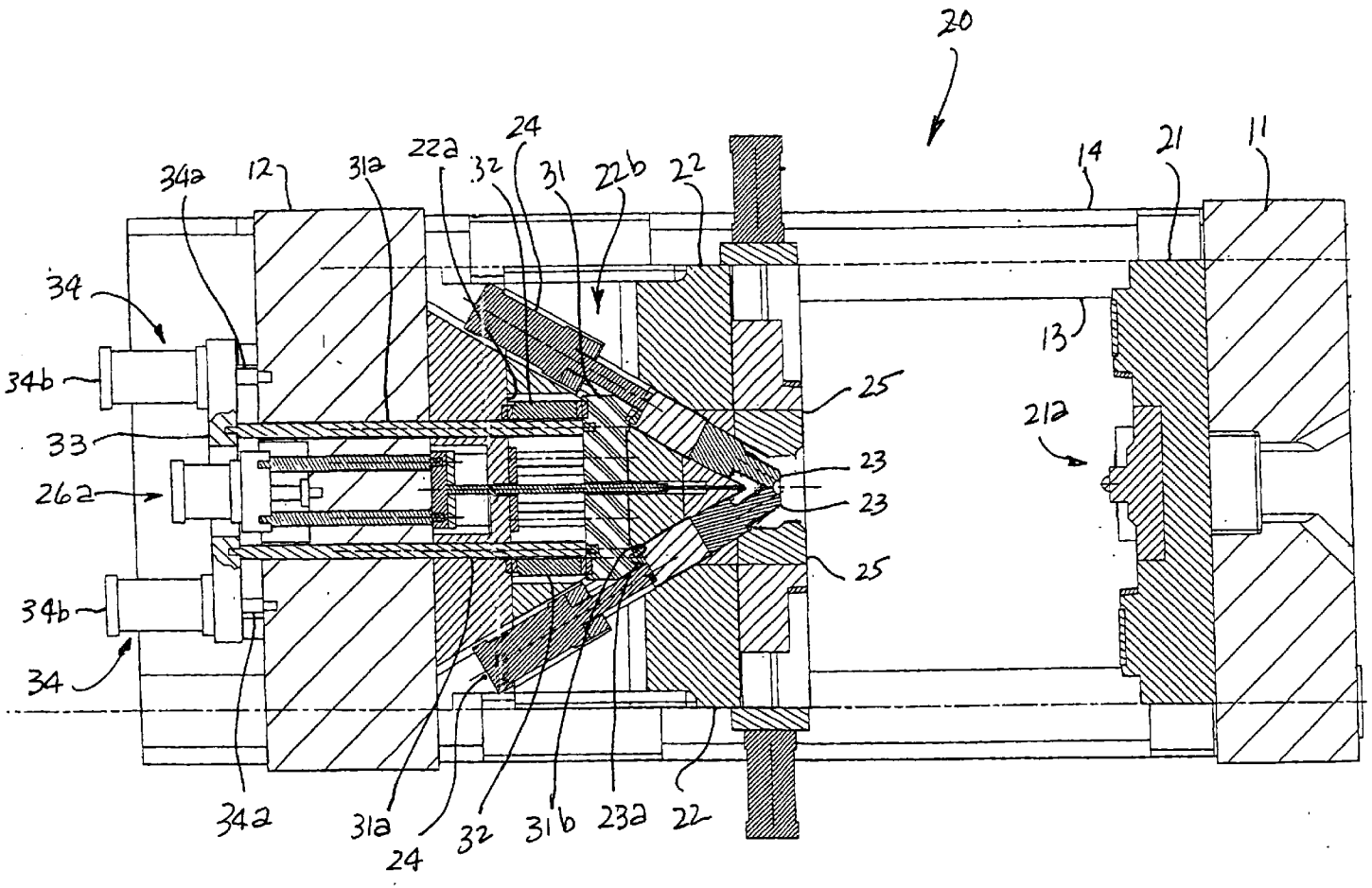
FIG. 3 is an illustration, corresponding to FIG. 1, of the die of FIGS. 1 and 2 with its cylinder-forming die core pieces and cavity-forming slides in their cavity-forming positions.

As known in the art, the die 20 includes a plurality of cavity-forming slides 25 that are also carried by the movable die element 22 and are reciprocatable in a direction perpendicular to the direction of movement of the movable die element 22, which is toward and away from the stationary die element 21 (Compare FIGS. 2 and 3). When the die is closed, as shown in FIG. 4, movable die element 22, die core pieces 23, and slides 25 cooperate with a cavity-forming portion 21*a* of the stationary die element 21 to form a cavity for an internal combustion engine V-block.

Also as known in the art, a part ejector 26 is carried by the movable die element 22 and is operated by hydraulic cylinders (not shown) connected between the movable platen 12 and the rearward elements 26*a* of the part ejector, which are slidably carried in the movable platen 12 and movable die element 22.

Figure 4:
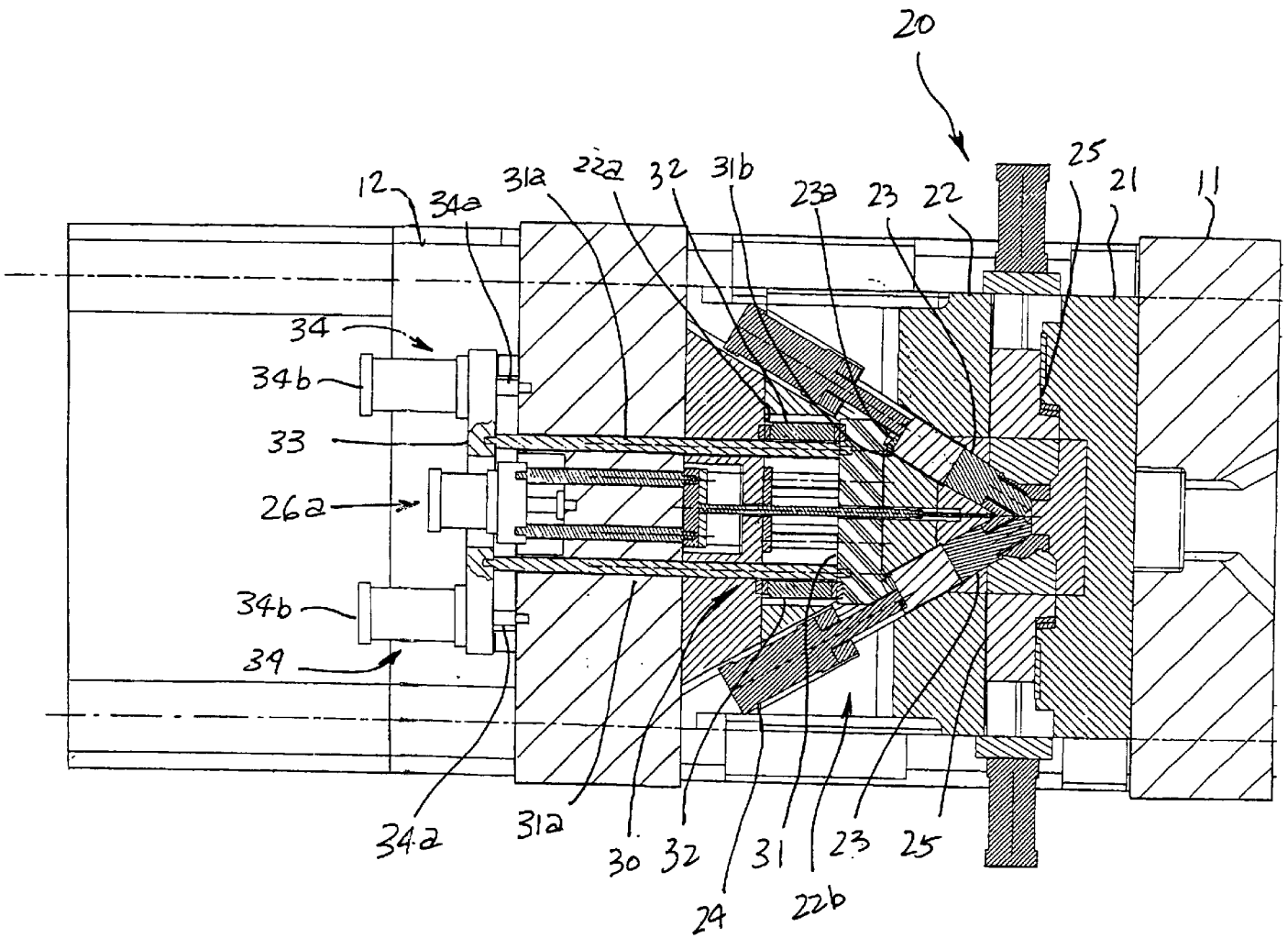
FIG. 4 is an illustration, corresponding to FIG. 1, of the die of FIGS. 1–3 in the die-closed position.

In the invention a die core locking means 30 is carried by the movable die element 22 and is movable between a first position where it engages and locks the die core pieces 23 in their extended cylinder-forming positions, as shown in FIGS. 2–4, and a second position out of engagement with the die core pieces 23, as shown in FIGS. 1 and 5–8.

In the preferred die core locking means 30 illustrated in FIGS. 1–10, a die core locking member 31 is carried within the movable die element 22 and can be actuated by a pair of double-acting hydraulic cylinders 34 connected at one end to the movable platen 12 on which the movable die element 22 is carried and at the other end to a bar 33 at the rear of the connection rods 31*a* of the die core locking member 31, which are slidably carried by the movable platen 12 and movable die element 22. Although the illustrated embodiment shows the piston element 34*a* engaged with the movable platen 12 and the cylinder 34*b* engaged with the bar 33, other mounting arrangements for the hydraulic cylinder actuators of the die core locking means 30 may be used, e.g., actuators may be carried by the die casting machine for operation of the die core locking means 30.

The die core locking member 31 has a pair of angled wear surfaces 31*b* at its forwardmost end, which engage wear surfaces 23*a* at the rear of the die core pieces 23 when the die core pieces 23 are in their extended positions and the die core locking member 31 is in its forward position, as shown in FIGS. 2–4 and 10. In addition, as shown in FIGS. 2–4 and 10, a plurality of sliding locks 32 are moved into a position between the rear face of die core locking member 31 and an internal surface 22*a* at the rear of movable die element 23 to hold the die core locking member 31 in engagement with the die core pieces 23 as molten metal is injected under high pressure into the die cavity.

As illustrated by FIGS. 1–8, the movable die core element 22 can form an internal cavity 22*b* which carries the die core locking means 30. As best illustrated by FIG. 2, the cavity 22*b* has an open front portion into which the rear ends 23*a* of the die core pieces 23 extend when the die core pieces 23 are in their extended positions, and the die core locking means 30 can move within internal cavity 22*b* , as explained above, from its second position (shown in FIG. 1) to its first position where its forwardmost die core engagement surfaces 31*b* abut the rear ends 23*a* of the die core pieces 23. In the preferred embodiment illustrated, the cavity 22*b* encompasses the die core locking member 31 and locks 32 and provides an internal surface 22*a* that prevents the die core pieces 23 from being moved from their extended cylinder-forming position by the injection pressure of the molten metal when the locks 32 are moved inwardly within the cavity 22*b* between the rear end of the die core locking member 31 and internal surface 22*a*.

Figure 9:
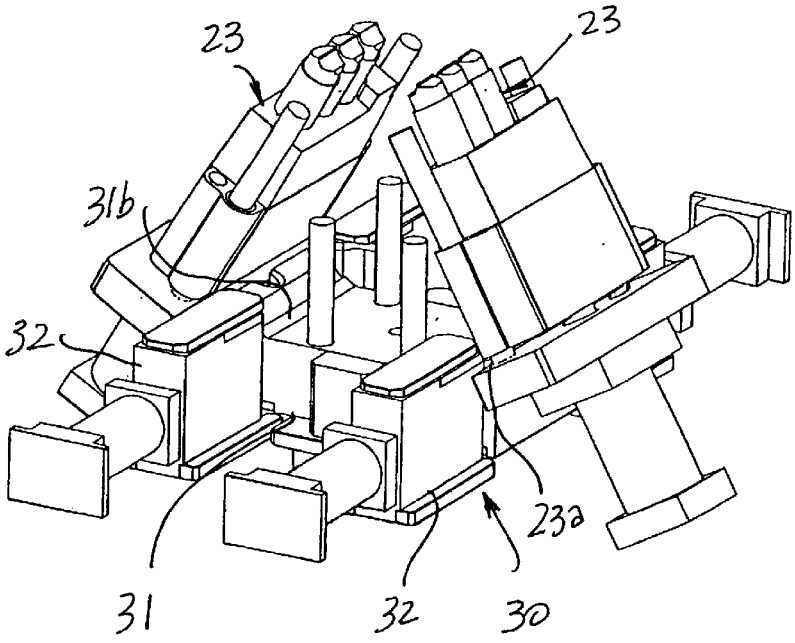
FIG. 9 is a perspective illustration of the preferred die core locking means carried by the movable die element of the die illustrated in FIGS. 1–8 with the die core pieces in their retracted positions (with the surrounding parts of the movable die element not shown)
Figure 10:
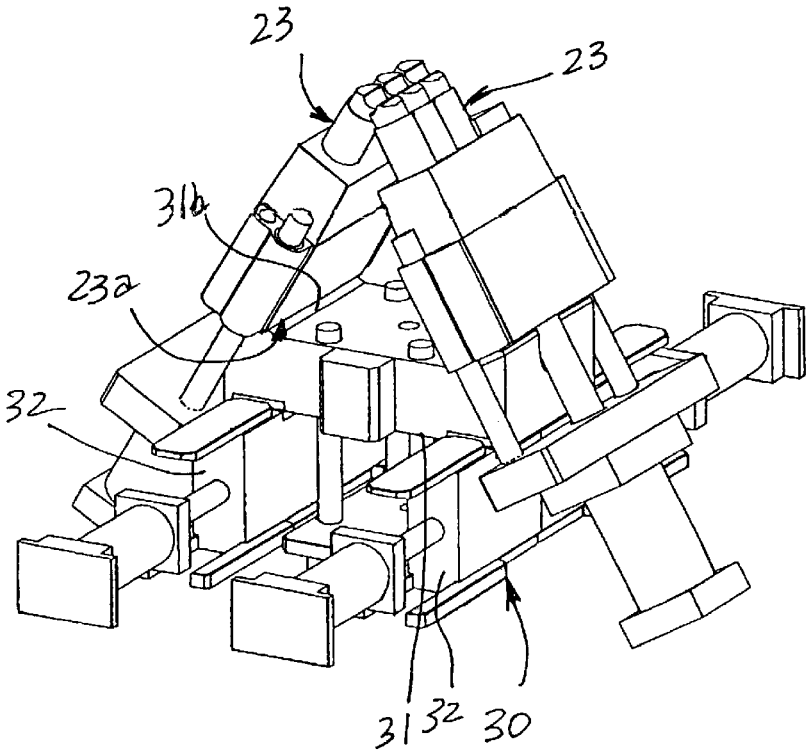
FIG. 10 is a perspective illustration of the preferred die core locking means of FIG. 9 with the die core pieces in their extended cylinder-forming positions and the die core locking means in its die core locking position.

FIGS. 9 and 10 illustrate, with the surrounding cavity-forming portion of the movable die element 22 removed, the die core pieces 23, die core locking member 31 and slide locks 32 in their FIG. 1 and FIG. 2 positions, respectively.

As illustrated in FIG. 9, the die core pieces 23 are in their retracted positions, which is within the movable die element 22 and out of engagement with any cast V-block; the die core locking member 31 is in its rearward position out of engagement with the die core pieces 23, and the locks 32 are in their outward positions free from engagement with the die core locking member 31 and the die core pieces 23.

As illustrated in FIG. 10, the die core pieces 23 are in their extended, cylinder-forming positions; the die core locking member 31 has moved forwardly to engagement position with the angled wear surfaces 31*b* at its forwardmost end engaged with wear surfaces 23*a* at the rear of die core pieces 23; and slide locks 32 have moved inwardly between the die core locking member 31 and a rear internal surface 22*a* of the movable die element 22 to hold die core pieces 23 in their extended positions during casting. The rear internal surface 22*a* is not shown in FIGS. 9 and 10, but would be under the locks 32 as they are shown in FIGS. 9 and 10 (See FIGS. 1–8).

The following description of operation of a die 20 of the invention begins, as shown in FIG. 1, with the die 20 in its open position after a cast part has been ejected. In this position, the movable platen 12 and the movable die element 22 have been moved by the operating cylinder and toggle mechanism of the die-casting machine (not shown) rearwardly away from the stationary die element 21. The slides 25 have been moved outwardly by their actuators from the axis of movement of the movable platen 12 and movable die element 22. The die core locking member 31 has been moved rearwardly within the movable die element 22 out of contact with the die core pieces 23, and the die core pieces 23 have been retracted within the movable die element 22.

Next, the die core pieces 23 are extended from within the movable die element 22 and are locked in the extended position by engagement of their rear surfaces 23*a* with the die core locking member 31, which has been moved forwardly and is held in its forward position by slide locks 32, as shown in FIGS. 2 and 10. In this position, cylinder sleeves can be placed on the die core pieces 23 by robots.

As shown in FIG. 3, the slides 25 are then moved by their hydraulic cylinder actuators inwardly on the movable die element 22 to position their cavity-forming portions on the movable die element 22, and are locked in their cavity-forming positions by the inter-engagement of locking surfaces on the slides 25 and stationary die elements 21, as known in the art.

The operating cylinder and toggle mechanism of the die-casting machine then moves the movable platen 12, its attached movable die element 22, and the die core pieces 23 and cavity-forming slides 25 carried by the movable die element 22, into engagement with stationary die element 21 to close the die cavity, and molten metal is thereafter injected into the closed cavity to form the cast part, as illustrated in FIG. 4.

Figure 5:
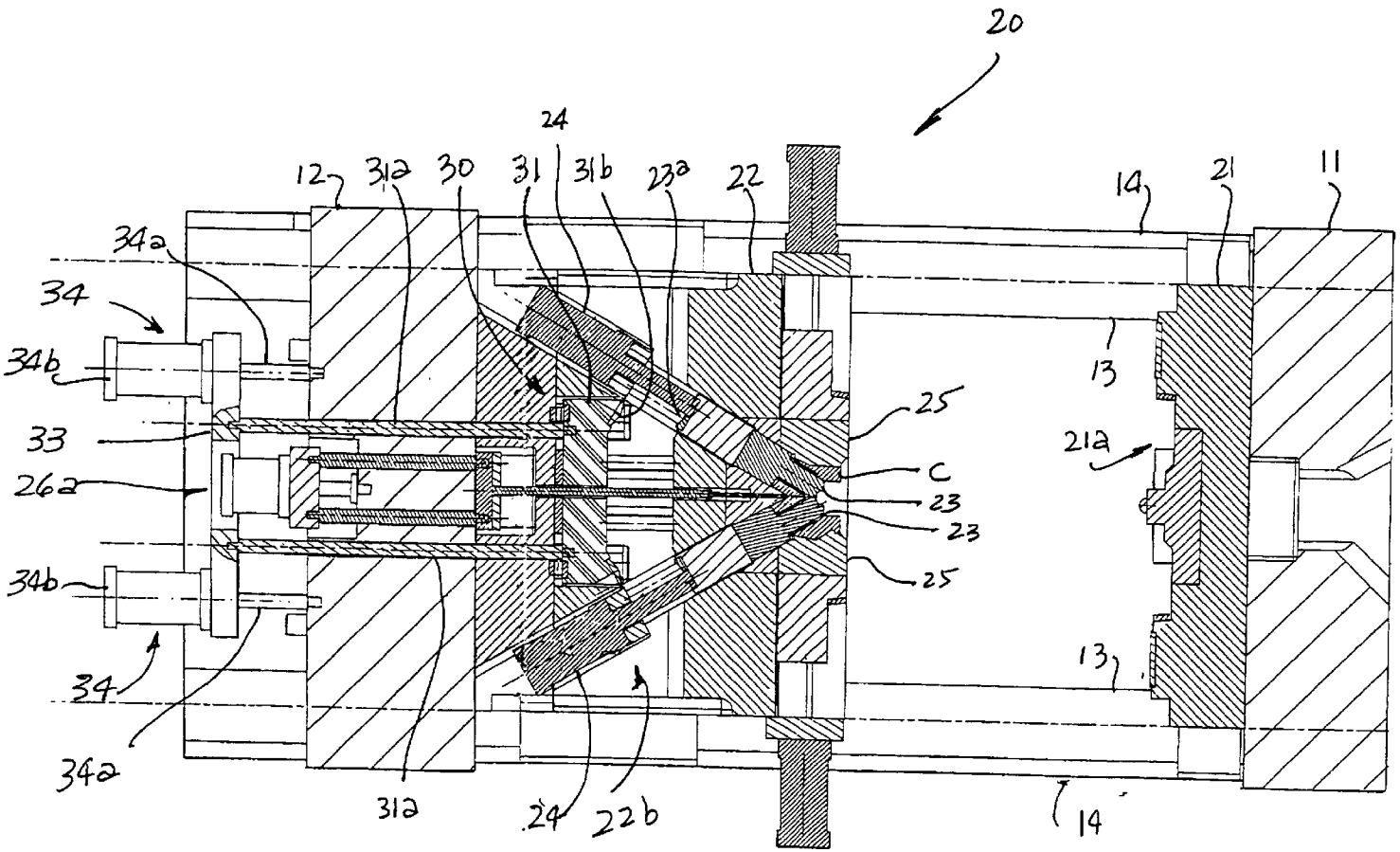
FIG. 5 is an illustration, corresponding to FIG. 1, of the die of FIGS. 1–4 in the open position with a cast V-block carried by the movable die elements.

In removing the cast part form the die, the movable platen 12 and movable die element 22 and the die parts carried by movable die element 22 are moved rearwardly away from the stationary die element 21, and with the movable platen 12 and movable die element 22 in their rear-most position, the slide locks 32 are removed from engagement with the die core locking member 31, and the die core locking member 31 is moved rearwardly within the movable die element 22, as shown in FIG. 5.

Figure 6:
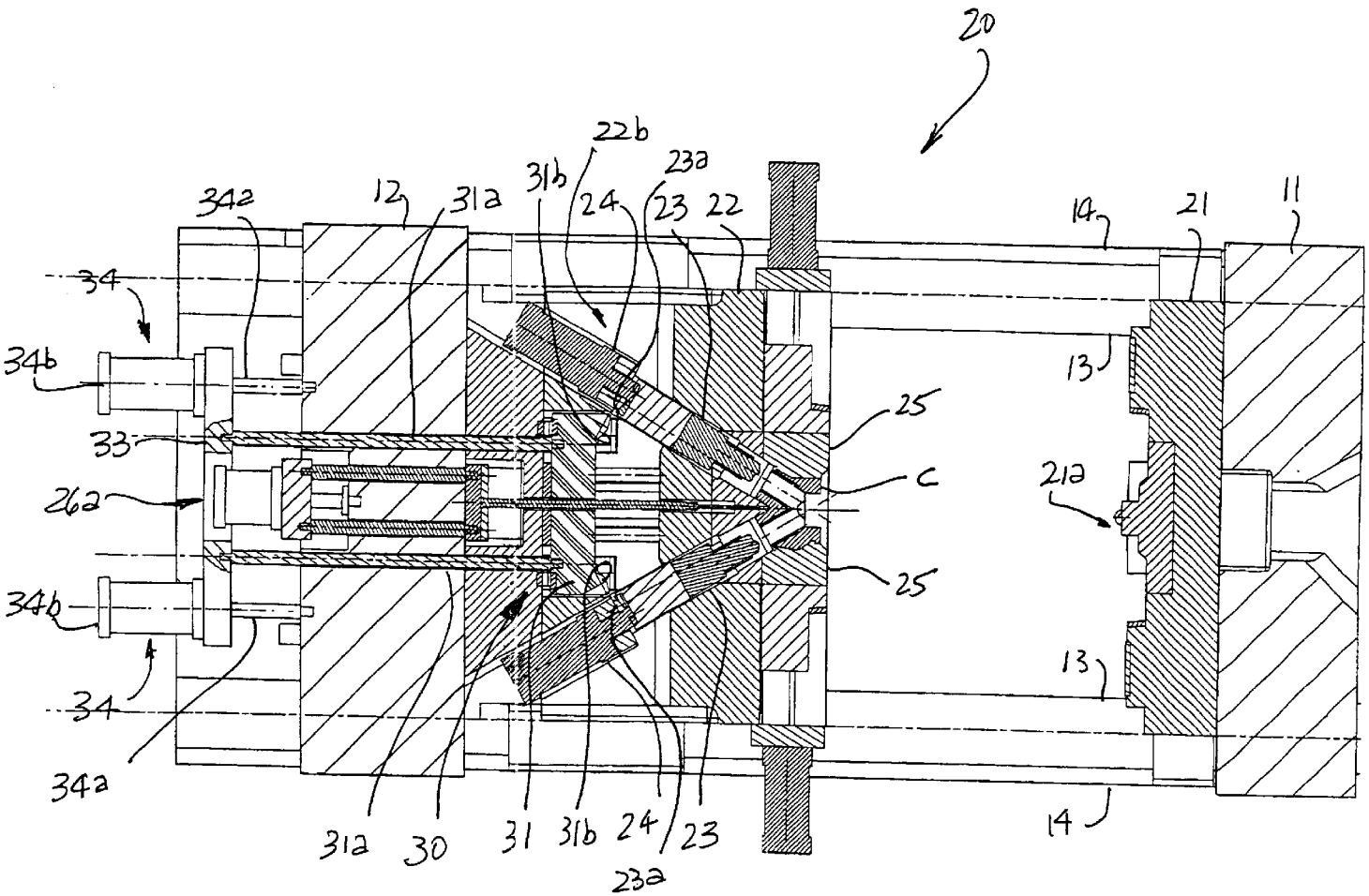
FIG. 6 is an illustration, corresponding to FIG. 1, of the die of FIGS. 1–5 in the open position with the cylinder-forming die core pieces retracted from the cast V-block.
Figure 7:
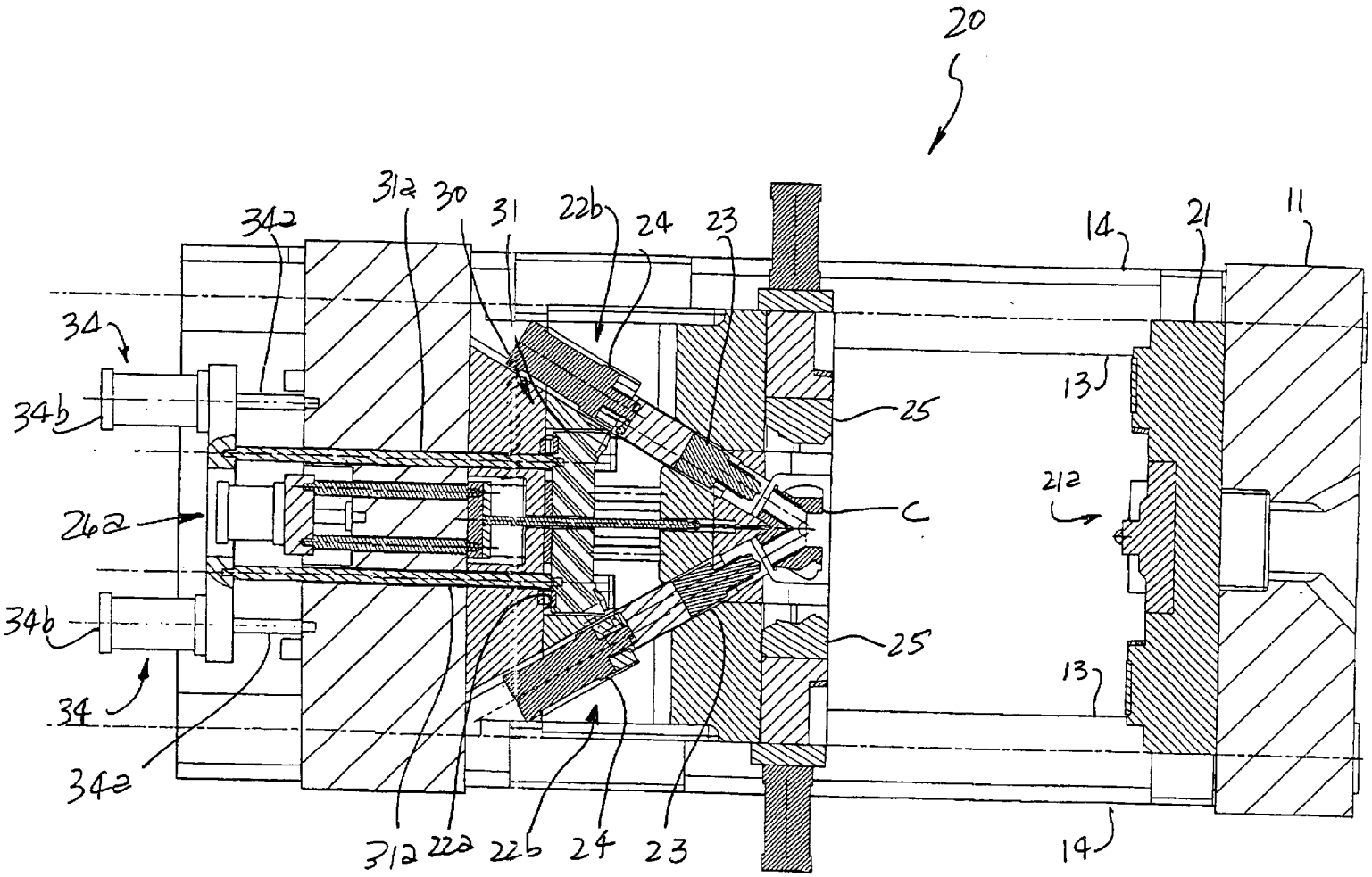
FIG. 7 is an illustration, corresponding to FIG. 1, of the die of FIGS. 1–6 in the open position with the cylinder-forming die core pieces and cavity-forming slides retracted from their part-engaging positions.
Figure 8:
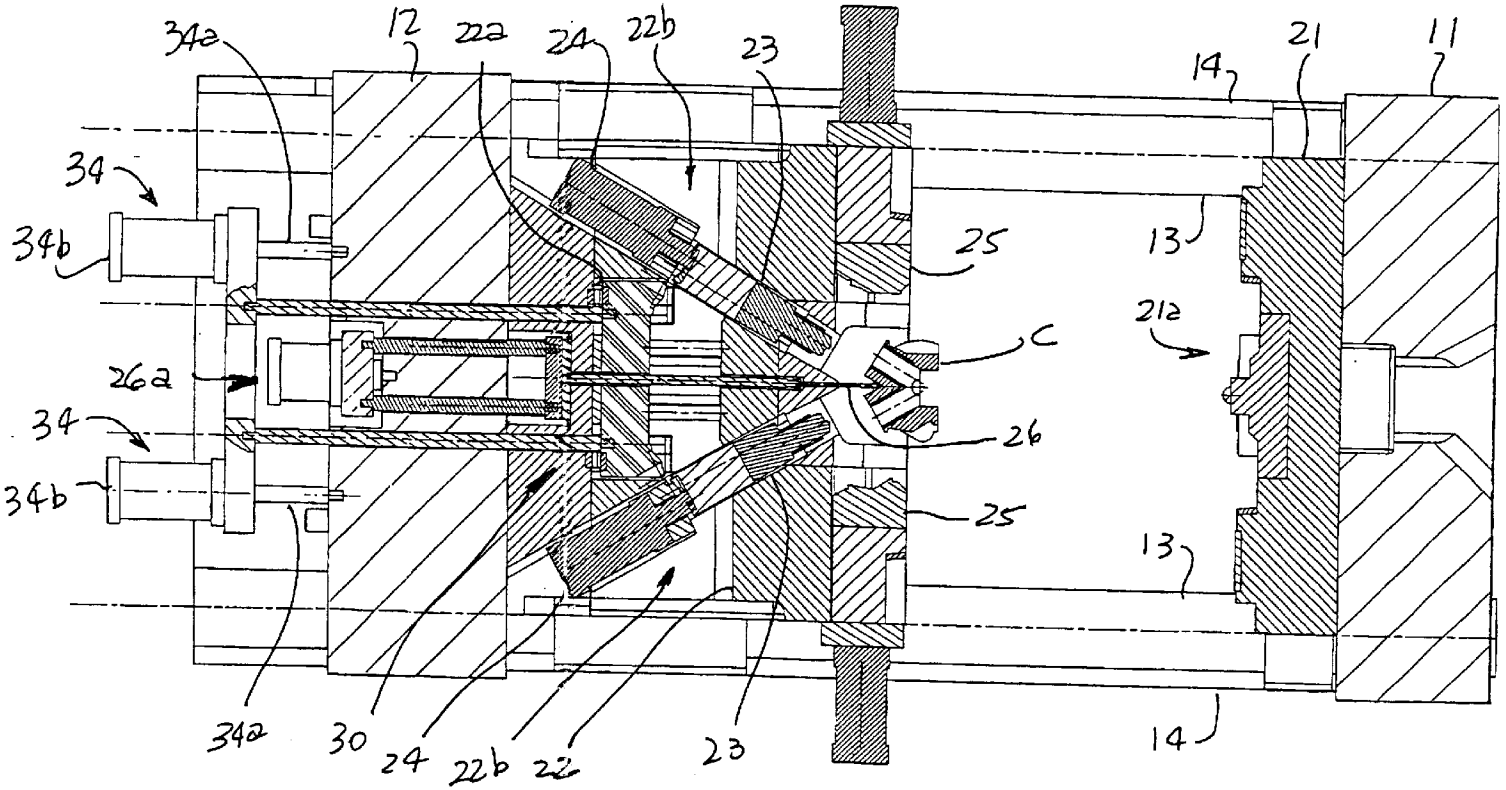
FIG. 8 is an illustration, corresponding to FIG. 1, of the die of FIGS. 1–7 in the open position with the part ejector operated to eject the cast V-block.

The die core pieces 23 are then retracted from the cast part and moved within the movable die element 22, as illustrated in FIG. 6; the slides 25 are moved outwardly on the movable die element 22 away from engagement with the cast part, as illustrated in FIG. 7; and the part ejector 26 is moved outwardly from the movable die element 22 to eject the cast part, as illustrated in FIG. 8.

In addition to providing a lighter, more compact and less expensive V-block die, with dies of the invention there is less chance for misalignment of the die core pieces and die core locking means because their alignment is determined by the surfaces of a single movable die element.

While the invention has been illustrated and described with respect to the best mode currently known, those skilled in the art will recognize that other modes, embodiments and variations are possible within the scope of the invention as set forth in the following claims.

What is claimed is:

1. A die for forming a die cavity for casting a V-block for an internal combustion engine, comprising a stationary die element including a cavity-forming surface for mounting on the stationary platen of a die-casting machine;

a movable die element for mounting on the movable platen of a die-casting machine for movement into cavity-forming engagement with said stationary die element, said movable die element including a cavity-forming surface portion, and carrying a plurality of slides including cavity-forming surfaces for movement transversely with respect to the movement of the movable platen and a pair of die core pieces reciprocatable in said movable die element at acute angles between extended positions in the die cavity and retracted positions substantially within said movable die element, said movable die element further carrying a die core locking member having forward die core engaging portions, said die core locking member being reciprocatable between a forward position, where said forward die core engaging portions engage rear portions of the die core pieces in their extended positions, and a rearward position out of contact with the die core pieces, and at least one sliding lock, carried by the movable die element for movement transversely of the movement of the die core locking member between an inward position between the die core locking member and an internal surface of the movable die element, thereby locking the die core pieces in their extended positions, and an outward position free of engagement with the die core locking member.

2. A die for casting a V-block for an internal combustion engine in a die-casting machine having a stationary platen and a movable platen, comprising a stationary die element for mounting on the stationary platen of the die casting machine, and a movable die element for mounting on the movable platen of the die-casting machine, said movable die element carrying a plurality of transversely movable, cavity-forming slides and at least a pair of cylinder-forming die core pieces for reciprocation at an acute angle with respect to the movement of the movable platen between extended positions within the die cavity and retracted positions within the movable die element, and die core locking means movably carried within the movable die element to a die core piece locking position.

3. A die for casting a V-block for an internal combustion engine in a die-casting machine having a stationary platen and a movable platen, comprising a stationary die element for mounting on the stationary platen of the die casting machine, and a movable die element for mounting on the movable platen of the die-casting machine, said movable die element carrying a plurality of transversely movable, cavity-forming slides and at least a pair of cylinder-forming die core pieces for reciprocation at an acute angle with respect to the movement of the movable platen between extended positions within the die cavity and retracted positions within the movable die element, and die core locking means movably carried within the movable die element to a die core piece locking position, wherein the die core locking means comprises a die core locking member reciprocatably carried within the movable die element along the axis of movement of the movable platen and operable in its forwardmost position to engage rear portions of the die core pieces and lock the die core pieces in their extended positions.

4. The die of claim 3, wherein the die core locking member is carried by the movable die element for reciprocatable movement within a cavity formed by the movable die element, said cavity having an open front portion into which the rear portions of the die core elements move in their extended positions, and including a rear surface.

5. The die of claim 4, wherein the cavity formed by the movable die element further contains a pair of lock elements reciprocatably carried for movement transverse to the movement of the die core locking member between inward positions between the die core locking member and the cavity rear surface, thereby preventing movement of the die core pieces within the die cavity, and outward positions permitting the die core locking element to disengage from the die core pieces and retraction of the die core pieces.

6. A die-casting assembly for casting a V-block for an internal combustion engine with a die-casting machine having a movable platen and a stationary platen, comprising a stationary die element mounted on the stationary platen of a die casting machine, a movable die element mounted on the movable platen of the die casting machine, said movable die element carrying a pair of cylinder-forming die core pieces for movement at acute angles with respect to the movement of the movable platen between extended positions for formation of the cylinder-forming portions of a V-block- forming die cavity and retracted positions removed from the die cavity, and independently operable die core locking means engageable with the die core pieces within the movable die, and further carrying a plurality of cavity-forming slides, said stationary die element, movable die element and plurality of slides and pair of die core pieces forming a die cavity for casting a V-block for an internal combustion engine when the die is closed.

7. The die-casting assembly of claim 6, wherein the die core locking means comprises a die core locking member reciprocatably carried within the movable die element along the axis of movement of the movable platen and operable in its forwardmost position to engage rear portions of the die core pieces and lock the die core pieces in their extended positions.

8. The die-casting assembly of claim 7, wherein the die core locking member is carried by the movable die element for reciprocatable movement within a cavity formed by the movable die element, said cavity having an open front portion into which the rear portions of the die core elements move in their extended positions, and including a rear surface.

9. The die-casting assembly of claim 8, wherein the cavity formed by the movable die element further contains at least one lock element reciprocatably carried for movement transverse to the movement of the die core locking member between a first position between the die core locking member and the cavity rear surface thereby preventing movement of the die core pieces within the die cavity and a second position permitting the die core locking element to disengage from the die core pieces and retraction of the die core pieces.

10. The die-casting assembly of claim 7, wherein the movable platen carries at least one actuator, and the independently operable die core locking means includes a connection rod extending through the movable die element and movable platen and connected with the at least one actuator for reciprocation by the actuator within the movable die element.

11. The die-casting assembly of claim 10, wherein the at least one actuator comprises two hydraulic cylinders connected at their one ends to the movable platen and at their other ends to a bar that drives a pair of connecting rods extending through the movable platen and movable die element for engagement with the die core locking member.

12. The die-casting assembly of claim 7, wherein at least one actuator for the die core locking member is carried by the die-casting machine and is connected with a connection rod engaged with the die core locking member.

13. The die casting assembly of claim 6 wherein the independently operable die core locking means is connected with at least one actuator carried by the die casting machines.

14. The die casting machine of claim 13 wherein the at least one actuator is carried by the movable platen of the die casting machine.

15. The die casting machine of claim 14 wherein the at least one actuator is carried at the back of the movable platen and is connected with the independently operable die core locking means by at least one connection rod passing through an opening in the movable platen.

16. The die casting machine of claim 13 wherein the independently operable die core locking means is independently driven form a first position engaging the die core pieces to a second position disengaged from the die core pieces by an actuator carried on the back of the movable platen of the die casting machine.

* * * * *

UNITED STATES PATENT AND TRADEMARK OFFICE

CERTIFICATE OF CORRECTION

PATENT NO. : 6,761,208 B2 
DATED : July 13, 2004
INVENTOR(S) : Gregg Edward Whealy and Ryan Andrew Haas It is certified that error appears in the above-identified patent and that said Letters Patent is hereby corrected as shown below:

Column 10,
Line 32, delete “form” and insert -- from --.

Signed and Sealed this

Sixteenth Day of November, 2004

JON W. DUDAS
*Director of the United States Patent and Trademark Office*